US009505236B2

(12) United States Patent
Suzuki

(10) Patent No.: US 9,505,236 B2
(45) Date of Patent: Nov. 29, 2016

(54) INKJET PRINTER WITH PRINTED INK COOLING MECHANISM

(71) Applicant: OKI DATA INFOTECH CORPORATION, Chiba-shi, Chiba (JP)

(72) Inventor: Kazuo Suzuki, Chiba (JP)

(73) Assignee: OKI Data Infotech Corporation, Chiba-shi, Chiba (JP)

( * ) Notice: Subject to any disclaimer, the term of this patent is extended or adjusted under 35 U.S.C. 154(b) by 0 days.

(21) Appl. No.: 14/773,803

(22) PCT Filed: Apr. 30, 2014

(86) PCT No.: PCT/JP2014/061935
§ 371 (c)(1),
(2) Date: Sep. 9, 2015

(87) PCT Pub. No.: WO2014/203627
PCT Pub. Date: Dec. 24, 2014

(65) Prior Publication Data

US 2016/0101634 A1 Apr. 14, 2016

(30) Foreign Application Priority Data

Jun. 20, 2013 (JP) ..... 2013-129661
Feb. 19, 2014 (JP) ..... 2014-029986

(51) Int. Cl.
*B41J 11/00* (2006.01)
*B41J 29/377* (2006.01)
*B41J 29/13* (2006.01)

(52) U.S. Cl.
CPC ..... *B41J 11/0015* (2013.01); *B41J 11/0085* (2013.01); *B41J 29/13* (2013.01); *B41J 29/377* (2013.01)

(58) Field of Classification Search
CPC .. B41J 11/0015; B41J 11/0085; B41J 29/13; B41J 29/377
See application file for complete search history.

(56) References Cited

U.S. PATENT DOCUMENTS

2011/0199448 A1* 8/2011 Kaiho ..... B41J 11/002 347/102

(Continued)

FOREIGN PATENT DOCUMENTS

JP 2006264328 10/2006

OTHER PUBLICATIONS

International Search Report mailed Jun. 24, 2014, issued in International Application No. PCT/JP2014/061935.

*Primary Examiner* — Bradley Thies
(74) *Attorney, Agent, or Firm* — Muncy, Geissler, Olds & Lowe, P.C.

(57) ABSTRACT

When an inkjet printer includes suction means for sucking the outside air into the inkjet printer, a heated recording medium is rapidly cooled by the air flowing in a vicinity of a discharge port for the recording medium. This causes fluctuations in surface temperature, resulting in degraded image quality. Accordingly, the inkjet printer has both a configuration capable of directly sucking, into a carriage, the outside air sucked into an apparatus, and a configuration of preventing the air from passing through an inside of the carriage. Thus, a temperature of the inside of the carriage can be reduced effectively. In order to prevent a reduction in temperature of the recording medium in the vicinity of the discharge port, a heater is arranged so as to increase a heating capacity of heating. Through temperature control on the heater based on a temperature of a region that is easily reduced in temperature, a local reduction in temperature of the recording medium is suppressed.

9 Claims, 4 Drawing Sheets

(56) References Cited

U.S. PATENT DOCUMENTS

2011/0285799 A1* 11/2011 Okura ..... B41J 11/0005 347/102

2013/0021417 A1* 1/2013 Ota ..... B41J 11/001 347/85

2013/0050370 A1* 2/2013 Sasaki ..... B41J 11/0015 347/102

* cited by examiner

INKJET PRINTER WITH PRINTED INK COOLING MECHANISM

TECHNICAL FIELD

The present invention relates to an inkjet printer.

BACKGROUND ART

There is known an inkjet printer for recording an image or the like by ejecting ink onto a recording medium, such as recording paper and a resin film. In the inkjet printer, various types of inks are used. Examples of the inks include solvent ink using an organic solvent as a prime solvent, ultraviolet curable ink that is curable due to ultraviolet radiation, and thermosetting ink that is curable due to heat. The various types of inks are used depending on intended use.

In recent years, there has been a growing demand to quickly dry ink in order to promptly shift to a next work process, such as lamination of a film so as to protect a printed surface after printing and cutting of a printed product into a desired size after the printing. To meet such a demand, methods utilizing properties of inks, such as the ultraviolet curable ink and the thermosetting ink, are examined.

On the other hand, the solvent ink using the organic solvent as the prime solvent is excellent in fixability onto a resin film such as a PVC film, thereby achieving an advantage in that a recorded product that is highly resistant to wear can be obtained. It is desired to enhance a drying property of this type of ink. To enhance fixability onto the recording medium, this type of ink is ejected under a state in which the recording medium is moderately heated, and also after the recording, the recording medium is moderately heated in order to quickly dry the solvent. For example, a platen, a paper guide provided on a front side of the platen, and a paper guide provided on a rear side of the platen are each heated, and owing to the heat, the recording medium may be heated. Further, a temperature of the recording head is also increased due to the heat and the self heat. On the other hand, when the temperature of the recording head or the ink is changed, the viscosity of the ink is changed accordingly, which adversely affects the ejection performance and the image quality. Thus, it is necessary to moderately cool the recording head and the ink.

For example, JP 2006-264328 A discloses a technology relating to air blowing and cooling in the printer. The related art discloses an inkjet printer using the thermosetting ink that promotes fixing due to heat. This device has a structure in which a heater is arranged above the carriage so as to extend along a scanning direction of the carriage. Therefore, the carriage is considerably heated, and hence is required to be cooled. The flow of the air is forcibly formed so as to cool the carriage by the air.

CITATION LIST

Patent Literature

[PTL 1] JP 2006-264328 A

SUMMARY OF INVENTION

Technical Problem

In the printer including a fan for supplying outside air into a housing in which the carriage is moved, air pressure of an inside of the housing is increased, and hence the air flows to an outside of the housing through a gap of the housing. Further, when the gap is narrow, the air flows at high speed, thereby enhancing cooling performance. For example, in order to prevent dust and the like from adhering to an object to be printed under recording, a cover such as a flap is arranged over a discharge port for discharging the recording medium, and the discharge port is formed into a narrow port. When the air flows to the outside of the housing through the discharge port, the air flows at high speed, which causes a problem in that the recording medium is hit and cooled by the air. In order to enhance a drying property of ink, the recording medium after recording needs to be moderately heated. A reduction in temperature deteriorates the drying property. Further, when there are fluctuations in temperature distribution, a time period for drying the ink fluctuates, thereby causing degraded image quality. In order to enhance the drying property of the ink, the recording medium after the recording needs to be heated so as to keep a constant temperature in an entire region of a front paper guide. When an upper portion of the front paper guide is reduced in temperature, drying of the ink is insufficient, thereby causing degraded image quality. Further, extreme temperature rise causes wrinkles and the like on the recording medium, and hence an upper limit temperature of the front paper guide is determined. When the front paper guide is locally reduced in temperature, the entire front paper guide may be increased in temperature to allow the portion of the front paper guide locally reduced in temperature to keep a constant temperature. However, the upper limit temperature is determined, and hence the entire front paper guide cannot be increased in temperature. It is necessary to keep the front paper guide at the determined constant temperature.

Solution to Problem

According to one embodiment of the present invention, there is provided an inkjet printer for recording an image on a recording medium by ejecting ink onto the recording medium from a recording head while intermittently conveying the recording medium, the inkjet printer including: a recording head for ejecting ink onto a recording medium from a plurality of nozzles; conveyance means for conveying the recording medium; a carriage having the recording head mounted therein, the carriage being reciprocable in a direction intersecting with a conveyance direction of the recording medium; a platen for retaining the recording medium, the platen being arranged so as to be opposed to a surface of the recording head on which the plurality of nozzles are arranged; a housing having at least the platen and the carriage accommodated therein; a front paper guide arranged on a downstream side of the platen in the conveyance direction, for guiding the recording medium, the front paper guide including a heater for heating the recording medium; housing-suction means arranged on a rear surface side of the housing, for sucking a gas from an outside into an inside of the housing; and a cover connected to the housing in a pivotable manner and having a distal end arranged at a distance from the front paper guide so that the distal end is positioned lower in a vertical direction than the surface of the recording head on which the plurality of nozzles are arranged, in which the cover is arranged closer to the front paper guide as approaching the distal end, in which the front paper guide is curved in the vertical direction, in which a part of the gas sucked by the housing-suction means is discharged through a portion between the front paper guide and the cover, and the discharged gas cools the recording medium on the front paper guide, and in which a part of the heater, which is arranged on the front paper guide on an upstream side in the conveyance direction of the recording medium, has a higher heating capacity of heating the front paper guide than another part of the heater arranged on the downstream side so that the cooling is suppressed.

Advantageous Effects of Invention

The outside air sucked into an apparatus enters the carriage as it is, thereby preventing an increase in temperature of the inside of the carriage. Further, even when the gas is exhausted through the discharge port for the recording medium, a reduction in temperature of the recording medium in a vicinity of the discharge port is suppressed, thereby preventing degradation of image quality.

DESCRIPTION OF EMBODIMENTS

An embodiment of the present invention is described with reference to the drawings.

Figure 1:
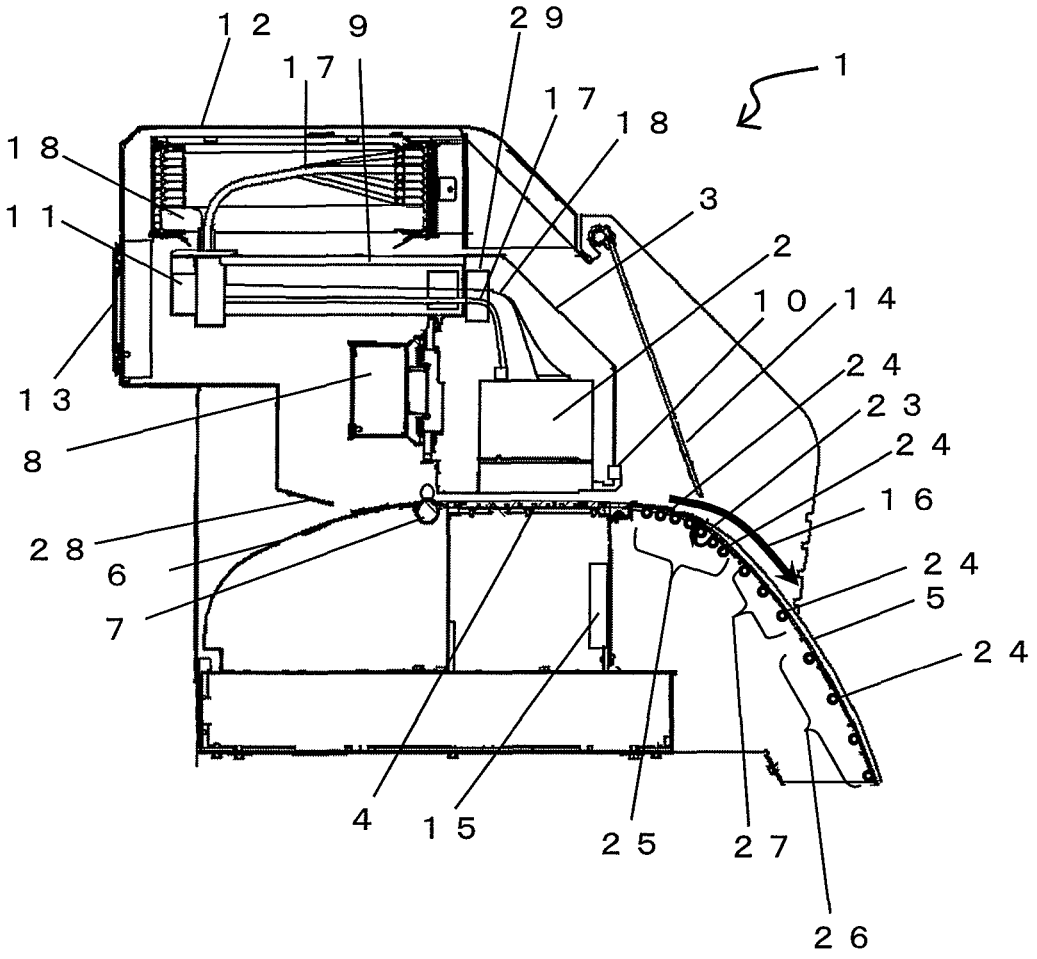
FIG. 1 is a cross-sectional view of an inkjet printer.

FIG. 1 is a cross-sectional view of an inkjet printer. In an inkjet printer 1, a carriage 3 having an inkjet-type recording head 2 mounted therein reciprocates in a depth direction of the drawing sheet. The carriage 3 is movable along a rail 8. A platen 4 is arranged at a position opposed to a nozzle surface of the recording head 2. The platen 4 is formed of a flat plate, and a large number of through holes are formed in the platen 4. A sealed space is formed below the platen 4, and the air is discharged from the sealed space by a suction fan 15. When the air is discharged, air pressure of the sealed space is decreased. The through holes are formed in the platen 4, and hence a recording medium is attracted onto the platen 4. A large number of nozzles are formed in the nozzle surface of the recording head 2, and ink is ejected through the nozzles. The ink is ejected depending on a position of the carriage 3, thereby recording a desired image on the recording medium.

A front paper guide 5 is provided on a downstream side of the platen 4 along a conveyance direction of the recording medium, and a rear paper guide 6 is provided on an upstream side thereof. Conveyance rollers 7 are arranged in a portion between the rear paper guide 6 and the platen 4. The recording medium is heated in the rear paper guide 6, and conveyed while being nipped by the conveyance rollers 7 and pinch rollers paired with the conveyance rollers 7. Then, the recording medium is sent to the platen 4, and further delivered along the front paper guide 5. A heater is also provided in each of the platen 4 and the front paper guide 5 so as to heat the recording medium. In this manner, drying of ink adhered to the recording medium is promoted.

A bending portion 28 corresponding to a portion at which an end portion of a housing 12 is bent is arranged above the rear paper guide 6 so as to be opposed to the rear paper guide 6. The bending portion 28 is bent toward an inward direction of the housing 12, and is closer to the rear paper guide 6 as approaching a distal end thereof. Further, the distal end portion of the bending portion 28 is arranged so as to be lower than a flat portion on a surface of the platen 4 in a vertical direction. With this, a gas sucked by housing-suction fans 13 arranged on a rear surface of the housing 12 easily flows, even in a small amount, toward the downstream side in the conveyance direction of the recording medium, that is, toward the carriage 3 or the cover 14. In other words, the sucked air is difficult to flow out through a portion between the bending portion 28 and the rear paper guide 6.

The front paper guide 5 is opposed to a distal end of the cover 14 provided above the front paper guide 5. Further, the cover 14 is closer to the front paper guide 5 as approaching a distal end thereof. The front paper guide 5 has a curved surface curved downward as approaching the downstream side in the conveyance direction of the recording medium. With the cover 14 and the front paper guide 5 configured as described above, the gas inside the housing 12 easily flows along a surface of the front paper guide 5. The heater is arranged in a portion inside the front paper guide 5 on a rear surface side thereof, and the recording medium is heated by the heater, to thereby promote the drying of the ink adhered to the recording medium. In this case, when a solvent that evaporates in the vicinity of a surface of the recording medium stagnates, the drying of the ink is inhibited. Therefore, the stagnation of the solvent is prevented by sending air. The cover 14 is arranged closer to the front paper guide 5 so as to form an air-flow along the front paper guide 5 in a direction indicated by the arrow 16, and is arranged so as to be oriented downward.

A duct 9 is arranged above the carriage 3 so as to extend toward a rear surface of the housing 12. A carriage-suction fan 11 is arranged at an end portion of the duct 9 on a rear surface side of the housing 12. The housing-suction fans 13 and the carriage-suction fan 11 are arranged so as to be opposed to each other.

The duct 9 is arranged at each end in a moving direction of the carriage 3. The carriage-suction fan 11, which serves as carriage-suction means for sucking the gas into the carriage 3, is arranged at a distal end of each duct 9. The gas is sucked by the carriage-suction fan 11, and passes through the duct 9 and an inside of the carriage 3. Then, the gas is discharged to an outside of the carriage 3, that is, into the housing 12 through an exhaust port 10 that is formed in a lower portion of a side wall of the carriage 3 on a front side of the printer, that is, formed in the lower portion of the side wall on the downstream side in the conveyance direction of the recording medium. The exhaust port 10 is directed to the cover 14, and the discharged gas flows toward the cover 14. The inside of the carriage 3 and the recording head 2 are cooled by the gas flowing inside the carriage 3. The exhaust port 10 is formed into an elongated hole along the moving direction of the carriage 3, that is, along a widthwise direction thereof. It is preferred that a through hole having an elongated hole shape be formed in the lower portion of the side wall of the carriage 3 on the front side so as to have a width corresponding to arrangement of the recording head 2. With this, the gas is easily discharged while cooling the recording head 2 without stagnating in the carriage 3.

A flat cable 18 and an ink tube 17 are arranged in a creeping manner so as to pass through a vicinity of a center portion of an opening portion 29 of the duct 9 formed on an inner side in a height direction thereof. A flow of the gas from the opening portion 29 of the duct 9 formed on the inner side is separated into an upper side and a lower side by the flat cable 18 and the ink tube 17. This generates an air-flow flowing in an upper side and a lower side of the inside of the carriage 3, and the air-flow is separated into the two sides, thereby effectively air-cooling the inside of the carriage 3. For example, the gas, which has been warmed after cooling the recording head 2, can be prevented from easily flowing to the upper portion of the carriage 3.

Each housing-suction fan 13 has a height larger than a height of the carriage-suction fan 11, which is twice as large as the height of the carriage-suction fan 11. In other words, as the housing-suction fan 13, a large-sized fan is used so as to suck a large amount of the outside air. The gas sucked into the housing 12 includes a gas that is sucked into the carriage 3 by the carriage-suction fan 11 and a gas that passes through the outside of the carriage 3. The sucked air is directed toward the cover 14 arranged on a front surface of the housing 12. The housing-suction fan 13 is prevented from being blocked by the carriage-suction fan 11, thereby being capable of reducing a sharp change in direction of the air-flow. The cover 14 is connected to the housing 12 in a pivotable manner. The opening portions 29 of the ducts 9 formed on the inner side of the carriage 3 are arranged so as to be open inward in a mutually opposed manner. The gas flows inside the carriage 3, and the flow of the gas is separated by the flat cable 18 into the upper side and the lower side. Further, the flow of the gas is also separated by the ink tube 17 into the upper side and the lower side. When separating the air-flow into the upper side and the lower side, the flat cable 18 acts more dominantly than the ink tube 17.

Further, the gas discharged from the exhaust port 10 is directed to the cover 14. The cover 14 is inclined, and hence the gas blown onto the cover 14 forms an air-flow along the cover 14 in a downward direction, and further flows along the front paper guide 5. The gas exhausted from the exhaust port 10 is discharged to the outside while being mixed with a gas flowing through the outside of the carriage 3. The gas sucked by the carriage-suction fans 11 flows faster than the gas flowing through the outside of the carriage 3 when discharged from the discharge port 10. Along with the air-flow from the discharge port 10, a gas surrounding the air-flow also flows faster, and hence the gas can be smoothly discharged from a portion between the front paper guide 5 and the cover 14 to the outside. It is possible to promote the discharge of the solvent having evaporated into the gas from the ink stagnating in the housing, and hence the ink can be dried in a shorter period of time.

A heater 24 is fixed on a back side of the front paper guide 5. The heater 24 is formed of a heating wire. The heater 24 is densely arranged in a dense region 25, and the heater 24 is arranged sparsely in a sparse region 26. In an intermediate region 27, the heater 24 is arranged so that a density of an electric wire is gradually decreased from the dense region toward the sparse region. In other words, a length of the heater 24 per unit surface area on a front side of the front paper guide 5 is divided into a long section and a short section, and the dense region 25 has a heating capacity higher than that of the sparse region 26. The heater 24 is arranged in the dense region 25 at a density two to three times higher than that in the sparse region 26. The air flows through the portion between the front paper guide 5 and the cover 14, and thus cools the portion. Accordingly, in order to prevent the front paper guide 5 from being locally reduced in temperature, the portion between the front paper guide 5 and the cover 14 has a heating capacity higher than that of the other portions. This is to prevent a reduction in temperature. Further, the intermediate region 27 is arranged to eliminate temperature fluctuations in the conveyance direction of an object to be printed, and to ensure a constant drying property by keeping a temperature on the paper guide constant. Further, a temperature sensor 23 is arranged in the dense region 25. Based on a temperature measured by the temperature sensor 23, temperature control is performed by turning on and off the heater 24 so as to keep the temperature of the front paper guide 5 constant. On an upstream side of the front paper guide 5 in the conveyance direction of the recording medium, ink is not dried, and hence image quality is liable to be affected on the upstream side of the front paper guide 5. Accordingly, it is particularly desired that the front paper guide 5 have less fluctuations in temperature distribution.

In order to attain a constant surface temperature of the recording medium on the front paper guide 5 at the time of printing, a heating capacity of heating the upstream side of the recording medium in the conveyance direction is increased, whereas the heating capacity is gradually reduced as approaching the downstream side thereof. In this manner, a problem of a temperature fall caused by the air-flow is prevented. In other words, the heater 24 is arranged on the front paper guide 5 at a density gradually reduced from the upper portion toward the lower portion of the front paper guide 5.

Approximately one-third to one-half of the upstream side of the front paper guide 5 in the conveyance direction is particularly cooled easily by the air-flow. Accordingly, a heating capacity of the heater 24 is increased in a region that is cooled easily.

Figure 2:
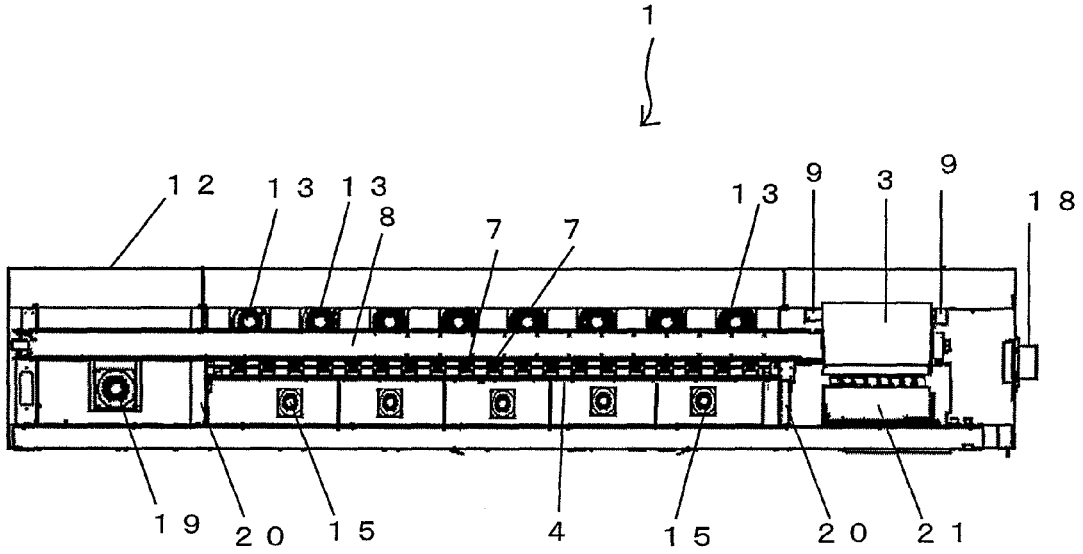
FIG. 2 is an explanatory view of arrangement of suction means and exhaust means in the inkjet printer.

FIG. 2 is an explanatory view of arrangement of suction means and exhaust means in the inkjet printer. A flow of the air in the housing 12 is described with reference to FIG. 2. The gas sucked into the housing 12 is discharged from a housing side surface-exhaust fan 18, a housing rear surface-exhaust fan 19, a portion between the rear paper guide 6 and the bending portion 28, or a portion between the front paper guide 5 and the cover 14, or through the suction by the platen 4. A large number of the housing-suction fans 13 serving as housing-suction means for sucking the gas are arranged on the rear surface of the housing 12 of the inkjet printer 1. The housing-suction fans 13 are arranged along a longitudinal direction of the housing 12. The housing-suction fans 13 are arranged so as to be opposed to the carriage-suction fan 11. This configuration is made to enable sucking a large amount of the air present outside the housing 12 into the carriage 1.

The rail 8 and the platen 4 are also arranged along the longitudinal direction of the housing. The platen 4 is a flat platen, and the large number of through holes are formed in the platen 4. Below the platen 4, there is secured a space partitioned by the platen 4, erecting plates 20 provided below both ends of the platen 4, and the like. A gas in the space is discharged to the outside through the suction fans 15 so as to generate negative pressure, and the recording medium conveyed on the platen 4 is sucked so as to be supported.

The air flows in the following route. Specifically, the air flows from the housing-suction fans 13 toward the cover 14, and flows downward along the cover 14 to be discharged to the outside through the gap between the front paper guide 5 and the cover 14.

A large number of the conveyance rollers 7 for conveying the recording medium are provided on the upstream side of the platen 4 along the conveyance direction of the recording medium. The conveyance rollers 7 are arranged along a longitudinal direction of the platen 4 at equal intervals. A maintenance unit 21 for the recording heads 2 is provided on one end of the housing 12. The maintenance unit 21 includes a wiper for wiping the nozzle surface of the recording head 2, and a cap for sucking ink while being held in close contact with the nozzle surface. The housing side surface-exhaust fan 18 is provided on a side surface of the housing 12 on the maintenance unit 21 side so as to exhaust the gas inside the housing 12 to the outside. Further, a space for turning when the carriage 3 reciprocates is secured on a side of the housing 12, which is opposite to the housing side surface-exhaust fan 18 across the platen 4. The housing rear surface-exhaust fan 19 is provided on the rear of the space, that is, the rear surface of the housing 12 so as to exhaust the gas inside the housing 12 to the outside. In this manner, the air is exhausted by the fans, thereby being capable of reducing an amount of the air discharged through the portion between the cover 14 and the front paper guide 5. As a result, cooling of the recording medium can be suppressed in some degree.

The maintenance unit 21 is provided on the housing side surface-exhaust fan 18 side, and hence the volume of a space in the housing 12 on the housing side surface-exhaust fan 18 side is smaller than the volume of the space in the housing 12 on the housing rear surface-exhaust fan 19 side. Therefore, the fans for exhausting the gas are respectively provided on the side surface on the side having the smaller volume and on the rear surface on the side having the larger volume. The flow degree of the gas is equalized as much as possible so that a difference in air resistance in the moving direction when the carriage 3 is moved is reduced.

Figure 3:
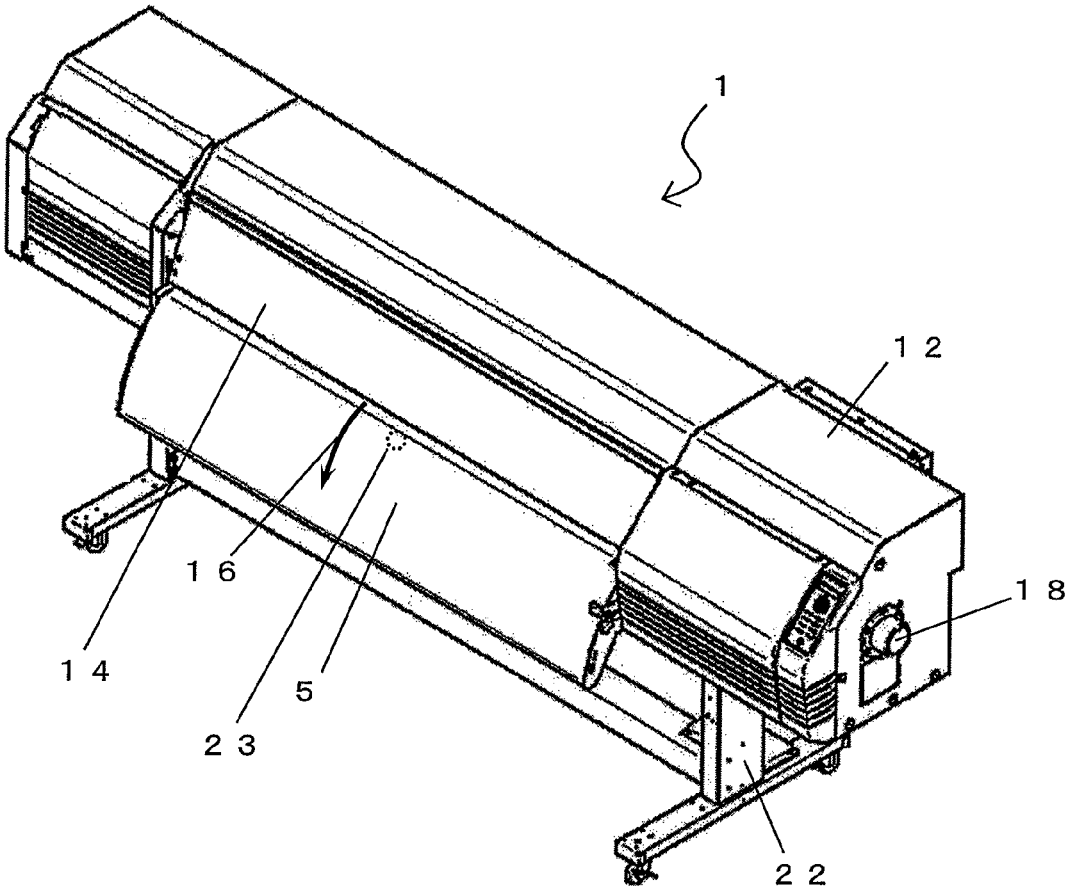
FIG. 3 is an external view of the inkjet printer.

FIG. 3 is an external view of the inkjet printer. In the inkjet printer 1, the housing 12 is supported by legs 22. The legs 22 are fixed to ends of a lower surface of the housing 12.

Figure 4:
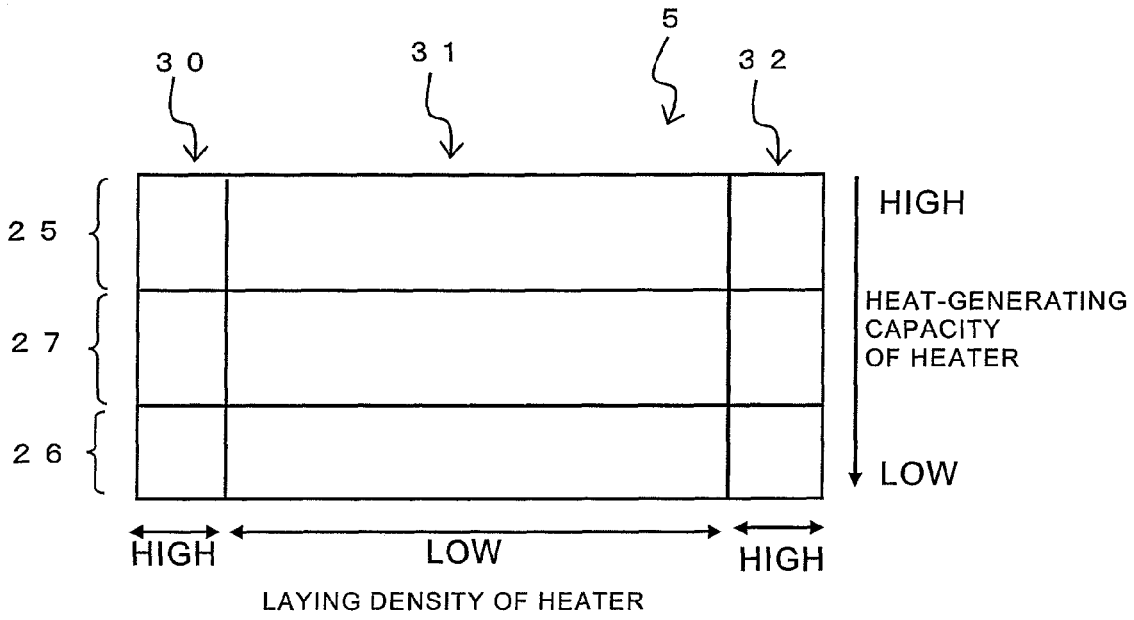
FIG. 4 is an explanatory view of an example of arrangement of a heater on a front paper guide.

FIG. 4 is an explanatory view of an example of arrangement of the heater on the front paper guide. FIG. 4 is a schematic view of the front paper guide 5 as seen from a front surface thereof. The built-in heater 24 is arranged at different densities in a center portion 31, a left end portion 30, and a right end portion 32 of the front paper guide 5. This configuration is made to prevent a reduction in temperature because a surface temperature of the front paper guide 5 is more liable to fall in the left end portion 30 and the right end portion 32 than in the center portion 30. In order to attain a uniform surface temperature, the built-in heater 24 is arranged on each end portion at a density higher than that on the center portion. For example, the heater 24 is extended from the center portion 30 side and laid on the end portion. Before returned to the center portion 30 from the end side, the heater 24 is bent to the end portion and laid on the end portion again, and then is returned to the center portion 30 side. In this manner, a laying density is doubled. The density can be increased by double laying.

Further, as the heater 24, there are used two or more types of heaters having different heat-generating capacities. The reason is as follows. When increasing the laying density of the heater on the upstream side in the conveyance direction of the recording medium, that is, at each end portion of the dense region 25, the laying density is originally high, and hence it is sometimes difficult to further increase the laying density. In this case, for example, there are used two or more types of heaters having different heat-generating capacities of heating per unit area of the heaters. A case of using three types of heaters is described herein. A heater having the highest heat-generating capacity is used in the dense region 25, and a heater having the lowest heat-generating capacity is used in the sparse region 26. A heater having an intermediate heat-generating capacity is used in the intermediate region 27. Thus, the laying density varies in the conveyance direction of the recording medium, and at the same time, the density in the end portion, can be increased. In other words, the laying density of the heater is high on the upstream side in the conveyance direction, and hence heaters having different heat-generating capacities are used in order to further increase the heat-generating capacities. With this configuration, the surface temperature can be easily equalized. In this case, as the heaters having different heat-generating capacities, for example, there are used wire heaters having different heat-generating capacities per unit length. A first heater having a high heat-generating capacity may be used in the dense region 25, and a second heater having a heat-generating capacity lower than that of the first heater per unit length may be used in the sparse region 26. A heater having an intermediate heat-generating capacity may be used in the intermediate region 27.

INDUSTRIAL APPLICABILITY

The present invention is applicable to an inkjet printer.

REFERENCE SIGNS LIST

1 inkjet printer
2 recording head
3 carriage
4 platen
5 front paper guide
6 rear paper guide
7 conveyance roller
8 rail
9 duct
10 discharge port
11 carriage-suction fan
12 housing
13 housing-suction fan
14 cover
15 suction fan
24 heater
25 dense region
26 sparse region

The invention claimed is:

1. An inkjet printer for recording an image on a recording medium by ejecting ink onto the recording medium from a recording head while intermittently conveying the recording medium, the inkjet printer comprising:

a recording head for ejecting ink onto a recording medium from a plurality of nozzles;

a conveyance device for conveying the recording medium;

a carriage having the recording head mounted therein, the carriage being reciprocable in a direction intersecting with a conveyance direction of the recording medium;

a platen for retaining the recording medium, the platen being arranged so as to be opposed to a surface of the recording head on which the plurality of nozzles are arranged;

a housing having at least the platen and the carriage accommodated therein;

a front paper guide arranged on a downstream side of the platen in the conveyance direction, for guiding the recording medium, the front paper guide comprising a heater for heating the recording medium;

a housing-suction device arranged on a rear surface side of the housing, for sucking a gas from an outside into an inside of the housing; and a cover connected to the housing in a pivotable manner and having a distal end arranged at a distance from the front paper guide so that the distal end is positioned lower in a vertical direction than the surface of the recording head on which the plurality of nozzles are arranged, wherein the cover is inclined relative to the vertical direction and arranged such that a distance between the cover and the front paper guide is reduced in the conveyance direction, thereby the gas flowing along the conveying direction from the housing-suction device is directed to a portion between the front paper guide and the distal end of the cover, wherein the front paper guide is curved in the vertical direction, wherein a part of the gas sucked by the housing-suction device is discharged through the portion between the front paper guide and the distal end of the cover in at least a length that corresponds to an entire width of the recording medium passing therethrough so that the discharged gas cools the entire width of the recording medium on the front paper guide as the recording medium is conveyed, and wherein a part of the heater, which is arranged on the front paper guide at a position at which the front paper guide is opposed to the distal end of the cover, which is on an upstream side in the conveyance direction of the recording medium, has a higher heating capacity of heating the front paper guide in the width direction of the recording medium than another part of the heater arranged on the downstream side so that the cooling is suppressed.

2. The inkjet printer according to claim 1, wherein the carriage comprises:

a duct arranged to protrude toward the housing-suction device, the duct comprising a carriage-suction device for sucking, into the carriage, the gas sucked by the housing-suction device, the carriage-suction device being arranged at a distal end of the protruding portion of the duct so as to be opposed to the housing-suction device; and an exhaust port with an elongated hole shape formed along the moving direction in a lower portion of a front surface of the carriage on the downstream side in the conveyance direction, wherein the gas sucked by the housing-suction device is separated into the gas flowing inside the carriage through the carriage-suction device, and the gas flowing outside the carriage, and wherein the gas discharged through the exhaust port is discharged toward the cover, and also discharged to an outside of the housing while mixed with the gas flowing outside the carriage.

3. The inkjet printer according to claim 1, further comprising a temperature sensor arranged at the position at which the front paper guide is opposed to the distal end of the cover, for measuring a temperature of the front paper guide, wherein based on the temperature detected by the temperature sensor, temperature control is performed so as to keep the temperature of the front paper guide constant.

4. The inkjet printer according to claim 1, wherein a part of the heater, which is located on an end portion side of the front paper guide in the direction intersecting with the conveyance direction, has a higher heating capacity of heating the front paper guide than another part of the heater arranged on a center portion side of the front paper guide.

5. The inkjet printer according to claim 1, wherein the heater comprises a first heater and a second heater having different heat-generating capacities, the first heater having the heat-generating capacity higher than the heat-generating capacity of the second heater, and wherein the first heater is arranged on a part of the front paper guide, which is located on the upstream side in the conveyance direction, and the second heater is arranged on a part of the front paper guide, which is located on the downstream side in the conveyance direction.

6. The inkjet printer according to claim 1, wherein the cover is arranged directly above the front paper guide along the conveyance direction of the recording medium.

7. The inkjet printer according to claim 1, wherein the cover is inclined relative to the vertical direction such that a connected end of the cover, which is connected to the housing, is arranged on the upstream side in the conveyance direction of the recording medium, and the distal end of the cover is arranged on a downstream side in the conveyance direction of the recording medium.

8. The inkjet printer according to claim 1, wherein the front paper guide is divided into a plurality of sections in the conveyance direction of the recording medium, and the heater in an upstream section of the front paper guide has the higher heating capacity than the heating capacity of the heater in a downstream section of the front paper guide.

9. The inkjet printer according to claim 1, wherein the heating capacity of the heater in the front paper guide decreases from the upstream side to the downstream side in the conveyance direction of the recording medium.

* * * * *